US005892332A

United States Patent [19]

Drews et al.

[11] Patent Number: 5,892,332

[45] Date of Patent: Apr. 6, 1999

[54] STARTER FOR A HIGH-PRESSURE GAS DISCHARGE LAMP

[75] Inventors: Ulrich Drews, Schwieberdingen; Bernd Rothfuss, Niefern-Oeschelbronn; Thomas Kienzler, Reutlingen, all of Germany

[73] Assignee: Robert Bosch GmbH, Stuttgart, Germany

[21] Appl. No.: 875,663

[22] PCT Filed: Oct. 28, 1996

[86] PCT No.: PCT/DE96/02047

§ 371 Date: Jul. 30, 1997

§ 102(e) Date: Jul. 30, 1997

[87] PCT Pub. No.: WO97/21329

PCT Pub. Date: Jun. 12, 1997

[30] Foreign Application Priority Data

Dec. 1, 1995 [DE] Germany ..... 195 44 838.3

[51] Int. Cl.[6] ..... H05B 37/02; H05B 41/32

[52] U.S. Cl. ..... 315/209 CD; 315/241 P; 315/290; 315/241 S; 315/291; 315/205; 315/289; 315/82; 315/77; 354/415

[58] Field of Search ..... 315/227 R, DIG. 5, 315/276, 209 CD, 205, 223, 241 S, 240, 238, 290, 241 P, 291, 307, 289, 244

[56] References Cited

U.S. PATENT DOCUMENTS

| | | | |
|---|---|---|---|
| 3,810,212 | 5/1974 | Biber | 315/241 P |
| 4,082,985 | 4/1978 | Bolhuis | 315/241 P |
| 5,036,256 | 7/1991 | Garrison et al. . | |
| 5,084,655 | 1/1992 | Van Zanten | 315/290 |
| 5,264,895 | 11/1993 | Takahashi et al. | 315/241 P |
| 5,426,346 | 6/1995 | Allison | 315/289 |

FOREIGN PATENT DOCUMENTS 4017415 2/1991 Germany .

*Primary Examiner*—Don Wong
*Assistant Examiner*—Wilson Lee
*Attorney, Agent, or Firm*—Venable; George H. Spencer; Norman N. Kunitz

[57] ABSTRACT

On one side, a high-pressure gas discharge lamp (10) is connected, by way of the secondary winding (16) of an ignition transformer (14), to a line (11) and, on its second side, to a second line (12). It is therefore connected to a first voltage $U_1$. A third line (13) delivers a further voltage $U_2$. The ignition energy is supplied with the aid of a pulse. For this purpose, a spark gap (17) is provided in series with the primary winding (15), which gap abruptly becomes conductive when the breakdown voltage is attained. A first capacitor (18) that is charged by the voltage $U_2$ by way of a resistor (20) connected in series is disposed in parallel to the first capacitor. The series connection of a second capacitor (19) and a diode (22) is provided in parallel to the first capacitor. The connecting point of the second capacitor and the diode is connected to the second line (12) by way of a resistor (21). This second capacitor 19 is charged by the voltage $U_1$. The ignition-current path is closed by a voltage-limiting element (23). When the spark gap breaks down, the first, then both, capacitors experience a graduated discharge.

10 Claims, 1 Drawing Sheet

STARTER FOR A HIGH-PRESSURE GAS DISCHARGE LAMP

RELATED ART

The invention is based on an ignition apparatus for a high-pressure gas discharge lamp, particularly for use in headlights of motor vehicles, of the type having an ignition transformer whose primary winding can be supplied with a voltage, and whose secondary winding ignites the high-pressure gas discharge lamp with the stepped-up value of the voltage, and wherein a capacitor is provided in parallel to the series connection of the primary winding and a controllable switch or the primary side, the capacitor is charged when the supply voltage is activated, and, when a certain voltage is attained, the capacitor is discharged by the switching on of the controllable switch for releasing the voltage.

A known ignition apparatus of this type, as described in DE 40 17 415 C2, includes an ignition transformer whose primary winding is supplied with a voltage. The secondary winding steps this voltage up to the voltage required to ignite the lamp. On the primary side, a capacitor is disposed in parallel to the series connection of the primary winding and a controllable switch formed by, for example, a thyristor. For ignition, this capacitor is charged to a voltage that is present and effective at that time. When a specific voltage is attained, the controllable switch is switched on and the capacitor is discharged for emitting the ignition pulse.

In this known ignition apparatus, a single capacitor supplies the total ignition energy and the energy required in the critical phase of the transfer of the high-pressure gas discharge lamp from the ignition operation into the burning operation. This capacitor must therefore be able to be charged to a very high voltage level, on the one hand, and, on the other hand, have the necessary capacity. This necessitates a costly and complex component that also has a considerably large space requirement.

SUMMARY AND ADVANTAGES OF THE INVENTION

In contrast, the ignition apparatus for a high-pressured gas discharge lamp according to the invention claim 1 has the advantage of improving the transfer behavior, because energy can be supplied later in the critical range of the transition of the high-pressure gas discharge lamp from the ignition operation to the burning operation. This is advantageously effected in that the total ignition energy need not be made available at the high voltage level due to the graduated capacitor discharge. This permits an economical utilization of space in the use of less expensive and smaller components. This leads to savings in space and costs.

In accordance with the invention, this is essentially achieved in that a second capacitor that is connected in series with a diode is provided in parallel to the capacitor, that this second capacitor can be charged to a lower voltage than the first capacitor, and that this second capacitor is then discharged by way of the correspondingly-polarized diode, and the switched-on, controllable switch is discharged into the primary winding if its voltage has become greater than that of the first capacitor during its discharge.

In a useful embodiment of the invention, the capacity of the second capacitor is approximately 2 to 5 times the capacity of the first capacitor.

In an advantageous modification of the invention, the voltage that charges the first capacitor is greater, preferably about two to five times greater, than the voltage that charges the second capacitor.

The invention can have two particularly advantageous embodiments. In one embodiment, the first capacitor can be charged by a separately-supplied voltage. This can also be referred to as the 3-conductor concept. In the other embodiment, which is to be referred to as the 2-conductor concept, the second capacitor can be charged by an internally-obtained voltage that is preferably smaller, by the voltage difference of a Zener diode, than the voltage with which the first capacitor can be charged.

In a further advantageous embodiment of the invention, it is provided that resistors are connected in series with the two capacitors, which resistors aid in the selection of the time constants of the charging of the capacitors, taking into account the energy necessary for igniting the high-pressure gas discharge lamp and its transition into the burning operation, such that the desired voltage is attained at the second capacitor when the controllable switch closes.

In a useful embodiment of the invention, the controllable switch is a spark gap that switches on when a specific voltage has been achieved.

In a further advantageous embodiment of the invention, a voltage-limiting element, e.g. a varistor, is provided between the input terminals of the ignition apparatus for protecting the voltage supply that supplies the ignition circuit against surges.

DRAWINGS

The invention is described in detail in the following description by way of embodiments illustrated in the drawings, wherein:

FIG. 1 is a first embodiment of the ignition apparatus configured in accordance with the invention, according to the 3-conductor concept, and FIG. 2 is a second embodiment of the ignition apparatus configured in accordance with the invention, according to the 2-conductor concept.

DETAILED DESCRIPTION OF THE PREFERRED EMBODIMENTS

Figure 1:
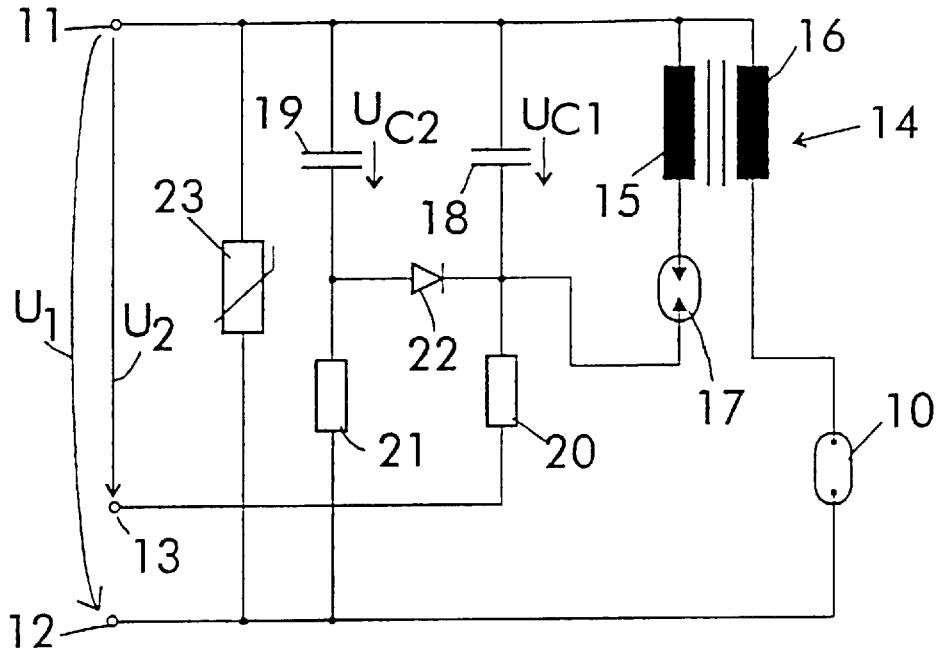

FIG. 1 shows a first embodiment of the ignition apparatus configured in accordance with the invention, which is designed according to the 3-conductor concept. A high-pressure gas discharge lamp 10 is connected on one side to a first connecting line 11 of a current-supply circuit, not shown, by way of a secondary winding 16 of an ignition transformer 14. The high-pressure gas discharge lamp 10 is connected on its second side to a second connecting line 12 of the current-supply circuit. A first voltage $U_1$ is applied between the connecting lines 11 and 12. A third connecting line 13 supplies a further voltage $U_2$ between the connections 11 and 13. The high-pressure gas discharge lamp 10 is supplied with both burning and ignition energy via these three connecting lines.

The ignition energy is supplied by the ignition apparatus configured in accordance with the invention, with the aid of a pulse. For this purpose, the ignition transformer 14 is provided with a primary winding 15 and the secondary winding 16, which are closely coupled to one another. A spark gap 17 is provided in series with the primary winding 15 as an economical, controllable switch that abruptly becomes conductive when the breakdown voltage is attained, thus generating the ignition pulse and permitting the flow of current through the primary winding 15. A first capacitor 18 is disposed in parallel to the series connection of the primary winding 15 and the spark gap 17. This first capacitor 18 is connected in series with a resistor 20 between the connecting lines 11 and 13, and is thus charged by the voltage $U_2$. The series connection of a second capacitor 19 and a diode 22 is provided in parallel to the first capacitor 18. The connecting point of capacitor 19 and diode 22 is connected to the connecting line 12 by way of a resistor 21. This second capacitor 19 is therefore in series with the resistor 21 between the connecting lines 11 and 12, and is thus charged by the voltage $U_1$. The diode 22 is polarized such that its anode is connected to the connecting point of the second capacitor 19 and the resistor 21, and its cathode is connected to the connecting point of the first capacitor 18 and the resistor 20, and to the one connection of the spark gap 17. A varsity 23 is disposed between the connecting lines 11 and 12 for protecting the current-supply circuit, not shown, from surges by the ignition transformer 14, and for closing the ignition-current path of the high-pressure gas discharge lamp 10.

The function of the above-described embodiment of the ignition apparatus configured in accordance with the invention is as follows. Until the breakdown of the spark gap 17, the first capacitor 18 is charged, by way of the resistor 20, with the voltage $U_2$, which is applied to the connecting line 13 and used only during ignition, and can therefore be characterized as an auxiliary voltage. At the same time, the voltage $U_1$, which is applied between the connecting lines 11 and 12 and supplies the takeover voltage and, later, the burning voltage of the high-pressure gas discharge lamp 10, charges the second capacitor 19 by way of the resistor 21. In this phase, the voltage $U_2$ is always greater than the voltage $U_1$. In an advantageous voltage ratio, the voltage $U_2$ is approximately 2 to 5 times the voltage $U_1$. This blocks the diode 22. The time constants for the charging of the capacitors, $T1=R_{20}* C_{18}$ for the first capacitor 18 and $T2=R_{21}* C_{19}$ for the second capacitor 19, are selected through the suitable selection of the resistors 20 and 21 such that the desired voltage $U_{C2}$ is achieved at the second capacitor 19 if the spark gap 17 switches on. The dimensioning of the capacitors, which has been chosen based on energy considerations, is a factor in the selection of the time constants. Moreover, it is useful to select the capacity of the second capacitor 19 to be approximately 2 to 5 times the capacity of the first capacitor 18.

When the spark gap 17 breaks down, a current flux occurs in the primary circuit comprising the first capacitor 18, the, primary winding 15 and the spark gap 17. According to the transmission ratio of the ignition transformer 14, this current flux generates a voltage in the secondary winding 16 that leads to the breakdown in the high-pressure gas discharge lamp 10. Following this breakdown, the light arc in the high-pressure gas discharge lamp must be stabilized. In addition, energy must be supplied later. In accordance with the invention, this is particularly effected in that, when the voltage $U_{C1}$ at the first capacitor falls below the value $U_{C2}$ at the second capacitor 19, the energy stored in the second capacitor 19 is available in addition to the energy stored in the first capacitor 18, and is stepped up, via the primary winding 15, by means of the secondary winding 16, then simultaneously transmitted with the other energy to the high-pressure gas discharge lamp 10. Therefore, according to the invention, the energy required during the transition from the ignition of the light arc into burning operation following the breakdown of the high-pressure gas discharge lamp 10 is supplied later at a significantly lower voltage level due to the graduated capacitor discharge.

Figure 2:
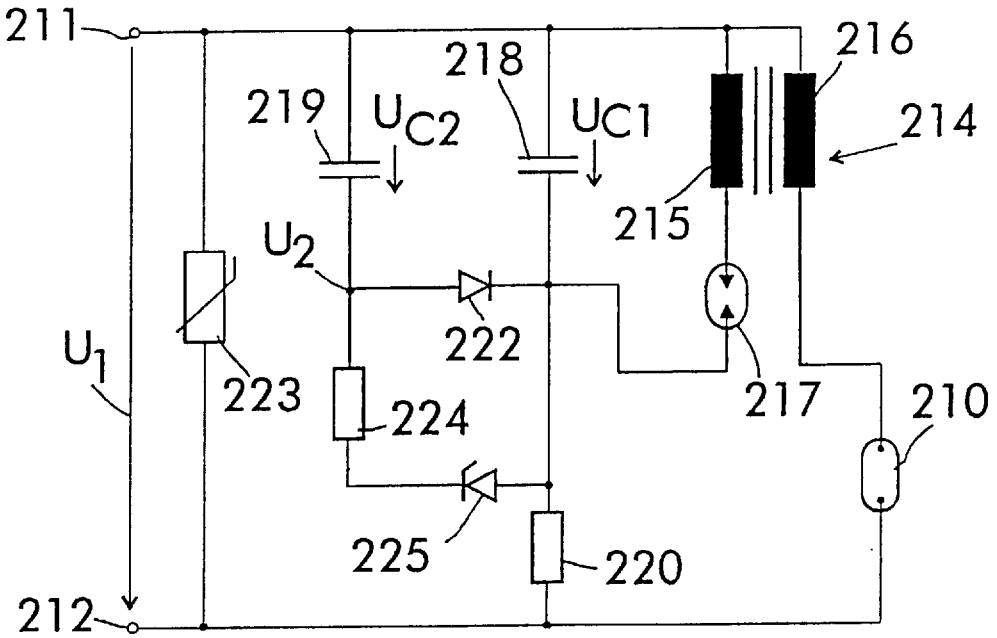

FIG. 2 shows a second embodiment of the ignition apparatus configured in accordance with the invention, which is designed according to the so-called 2-conductor concept. A high-pressure gas discharge lamp 210 is connected on one side to a first connecting line 211 of a current-supply circuit, not shown in detail, by way of a secondary winding 216 of an ignition transformer 214. The high-pressure gas discharge lamp 210 is connected on its second side to a second connecting line 212 of the current-supply circuit. A voltage $U_1$ is applied between the connecting lines 211 and 212. The high-pressure gas discharge lamp 210 is supplied with both burning and ignition energy via these three connecting lines.

The ignition energy is supplied by the ignition apparatus configured in accordance with the invention, with the aid of a pulse. For this purpose, the ignition transformer 214 is provided with a primary winding 215 and the secondary winding 216, which are closely coupled to one another. A spark gap 217 is provided in series with the primary winding 215 as a controllable switch that abruptly becomes conductive when the breakdown voltage is attained, thus generating the ignition pulse and permitting the flow of current through the primary winding 215. A first capacitor 218 is disposed in parallel to the series connection of the primary winding 215 and the spark gap 217. This first capacitor 218 is connected in series with a resistor 220 between the connecting lines 211 and 212, and is thus charged by the voltage $U_1$. The series connection of a second capacitor 219 and a diode 222 is provided in parallel to the first capacitor 218. The connecting point of capacitor 219 and diode 222 is connected to the connecting line 212 by way of the series connection of a resistor 224, a Zener diode 225 and the resistor 220. Hence, an internally-generated voltage $U_2$, which is lower than the voltage $U_1$ by the voltage of the Zener diode 225, is applied to the connecting point of this second capacitor 219 with the diode 222. The diode 222 is polarized such that its anode is connected to the connecting point of the second capacitor 219 and the resistor 224, and its cathode is connected to the connecting point of the first capacitor 218 and the resistor 220, and to the one connection of the spark gap 217. A voltage-limiting element 223, e.g. a varsity, is disposed between the connecting lines 211 and 212 for protecting the current-supply circuit, not shown, from surges by the ignition transformer 214, and for closing the ignition-current path of the high-pressure gas discharge lamp 210.

The function of the above-described second embodiment of the ignition apparatus configured in accordance with the invention is as follows, with only the features that differ from the first embodiment being discussed. The second capacitor 219 is charged to the voltage level $U_{C2}$ with the aid of a portion of the voltage $U_1$, specifically the internally-generated voltage $U_2$. This voltage arises from the subtraction of the breakdown voltage of the Zener diode 225 from the voltage $U_1$. The time constant for the first capacitor 218, $T1=R_{220}* C_{218}$, and the time constant for the second capacitor 219, $T2=C_{219}*(R_{220}+R_{224})$, are selected through a suitable selection of the resistors 220 and 224 such that the desired voltage $U_{C2}$ is attained at the second capacitor 219 when the spark gap 217 switches on. The dimensioning of the capacitors 218 and 219, which has been chosen based on energy considerations, is a factor in the selection of the time constants. Moreover, it is useful to select the capacity of the second capacitor 219 to be approximately 2 to 5 times the capacity of the first capacitor 218. The value of the resistor 224 can also be zero.

The function of this embodiment according to the 2-conductor concept is otherwise identical to the function explained in connection with the embodiment of FIG. 1.

An advantage of the ignition apparatus of the invention is that the total ignition energy does not need to be made available at the high voltage level. The graduated capacitor discharge permits economical utilization of space. Furthermore, the use of inexpensive capacitors is permitted, and an improvement in the transition behavior is achieved. In the critical range of the transfer of the high-pressure gas discharge lamp from the ignition operation into the burning operation, sufficient energy can be supplied later at the lower voltage level.

We claim:

1. Ignition apparatus for a high-pressure gas discharge lamp, particularly for use in headlights of motor vehicles, having an ignition transformer, whose primary winding can be supplied with a supply voltage, and whose secondary winding ignites the high-pressure gas discharge lamp with the stepped-up value of the voltage, wherein a first capacitor is provided in parallel to the series connection of the primary winging and a controllable switch on the primary side, the first capacitor is charged when the supply voltage ($U_1$) is activated, and, when a certain voltage is attained, the first capacitor, is discharged by the switching on of the controllable switch for releasing the voltage; and wherein: a second capacitor connected in series with a diode is provided in parallel to the first capacitor; circuit means are provided for charging this second capacitor to a lower voltage than the first capacitor; and this second capacitor is then discharged, via the properly-polarized diode and the switched-on controllable switch, into the primary winding when the voltage ($U_{C2}$) of the second capacitor has become greater than that ($U_{C1}$) of the first capacitor during its discharge.

2. Ignition apparatus according to claim 1, wherein the capacity of the second capacitor is approximately 2 to 5 times the capacity of the first capacitor.

3. Ignition apparatus according to claim 1, wherein the voltage ($U_2$ in FIG. 1, $U_1$ in FIG. 2) that charges the first capacitor is greater, than the voltage ($U_1$ in FIG. 1, $U_2$ in FIG. 2) that charges the second capacitor.

4. Ignition apparatus according to claim 1, wherein the first capacitor is charged by a separately supplied voltage ($U_2$).

5. Ignition apparatus according to claim 1, wherein the second capacitor { is charged by an internally-obtained voltage ($U_2$ in FIG. 2) that is smaller, by the voltage difference of a Zener diode, than the voltage ($U_1$) with which the first capacitor is charged.

6. Ignition apparatus according to claim 1, wherein resistors are provided in series with the first and second capacitors, with the aid of which resistors the time constants of the charging of the capacitors is selected, with consideration of the energy required for igniting the high-pressure gas discharge lamp and transferring it into the burning operation such that the desired voltage is attained at the second capacitor when the controllable switch closes.

7. Ignition apparatus according to claim 1, wherein the controllable switch is a spark gap that switches on when a certain voltage is attained.

8. Ignition apparatus according to claim 1, wherein a voltage-limiting element is provided between the input terminals of the ignition apparatus for closing the ignition-current path.

9. Ignition apparatus according to claim 3, wherein the voltage that charges the first capacitor is about 2 to 3 times greater than the voltage that charges the second capacitor.

10. Ignition apparatus according to claim 8, wherein the voltage limiting element is a varsity.

* * * * *